US005996908A

United States Patent [19]

Hofmann et al.

[11] Patent Number: 5,996,908

[45] Date of Patent: Dec. 7, 1999

[54] FILTER FOR A FUEL INJECTION VALVE FOR INTERNAL COMBUSTION ENGINES

[75] Inventors: Karl Hofmann, Remseck; Friedrich Boecking, Stuttgart, both of Germany

[73] Assignee: Robert Bosch GmbH, Stuttgart, Germany

[21] Appl. No.: 08/945,827

[22] PCT Filed: Sep. 30, 1996

[86] PCT No.: PCT/DE96/01870

§ 371 Date: Nov. 5, 1997

§ 102(e) Date: Nov. 5, 1997

[87] PCT Pub. No.: WO97/33085

PCT Pub. Date: Sep. 12, 1997

[30] Foreign Application Priority Data

Mar. 6, 1996 [DE] Germany ..... 196 08 608

[51] Int. Cl.[6] ..... F02M 61/04

[52] U.S. Cl. ..... 239/533.3; 239/575; 239/590.5

[58] Field of Search ..... 239/533.2, 533.3, 239/533.9, 575, 590, 590.5; 210/438, 446, 497.01; 123/299, 300, 460

[56] References Cited

U.S. PATENT DOCUMENTS

| | | | |
|---|---|---|---|
| 3,908,911 | 9/1975 | Hofmann et al. | 239/533.3 |
| 4,548,356 | 10/1985 | Hofmann et al. | 239/533.3 X |
| 4,627,574 | 12/1986 | Hofmann et al. | 239/590.5 |
| 4,768,719 | 9/1988 | Straubel et al. | 239/533.9 X |
| 5,413,281 | 5/1995 | Hofmann et al. | 239/533.9 X |

FOREIGN PATENT DOCUMENTS

| | | |
|---|---|---|
| 535831 A2 | 4/1993 | European Pat. Off. . |
| 616828 A1 | 9/1994 | European Pat. Off. . |

*Primary Examiner*—Andres Kashnikow
*Assistant Examiner*—Steven J. Ganey
*Attorney, Agent, or Firm*—Edwin E. Greigg; Ronald E. Greigg

[57] ABSTRACT

A fuel injection valve for internal combustion engines, having a fuel inflow conduit, which discharges at an injection opening, and into which inflow conduit a rodlike filter body is inserted, preceding the injection opening, which filter body on each of its face ends has one collar of enlarged diameter compared with a middle portion of the filter body, and into whose jacket face two groups of longitudinal grooves axially closed on one end are machined. A first group begins at an upper end face of the filter body remote from the injection opening and a second group begins at a lower end face thereof toward the injection opening, the longitudinal grooves of the first and second groups being distributed in alternation over the circumference of the filter body. To reliably prevent dirt particles from passing through the filter body, the lower collar extends past the axially closed end of the longitudinal grooves of the first group.

7 Claims, 1 Drawing Sheet

FILTER FOR A FUEL INJECTION VALVE FOR INTERNAL COMBUSTION ENGINES

PRIOR ART

The invention is based on a fuel injection valve for internal combustion engines. A fuel injection valve of this kind, known from European Patent Disclosure EP 0,084,182, has an inflow conduit, leading away from a connection stub for a fuel injection line, that discharges at an injection opening into the combustion chamber of the engine to be supplied. For trapping dirt particles and chips in the fuel, a fuel filter is inserted into the inflow conduit and is embodied as a rod filter.

The rotationally symmetrical filter body has one collar on each of its two face ends, and the collar protrudes past a middle portion of the face of reduced diameter. Two groups of longitudinal grooves, axially closed on one end, are machined into the jacket face of the filter body; of these grooves, a first group begins at the upper end face of the filter body, remote from the injection opening, and a second group begins at a lower end face of the filter body, toward the injection opening. The longitudinal grooves of the first and second groups are disposed in alternating distribution over the circumference of the filter body. When there is a flow of fuel through the inflow conduit, the fuel at the filter body is forced to flow through the narrow gap between the profiled outer circumference of the filter body in the middle portion and the wall of the inflow conduit surrounding it, so that dirt particles, chips and the like beyond a certain size that have been entrained in the fuel are trapped.

These chips and particles collect at the closed, reduced-cross section lower end of the longitudinal grooves that begin at the upper end face remote from the injection opening. In the course of the delivery of fuel, which is at very high pressure, into the inflow conduit, the impetus force generated by this high pressure now acts on the particles collected in the closed end, which as a result over a certain period of time drive axial channels from the closed end of the longitudinal grooves into the wall of the lower collar, on the injection side, of the filter body or into the inflow conduit wall opposite this narrow gap. After a certain period of time in operation, these channels achieve orders of magnitude through which even larger chips and dirt particles can pass, and these chips and dirt particles then plug up the injection opening at the injection valve or block the mobile guidance of the valve member, which can cause total failure of the injection system.

ADVANTAGES OF THE INVENTION

The fuel injection valve of the invention for internal combustion engines, has the advantage over the prior art that by means of the axial enlargement of the lower collar, toward the injection opening, to pass the closed end of the longitudinal grooves that begin at the upper end face, this kind of channel formation can be prevented. By extending the narrow gap on the lower collar toward the wall of the inflow conduit into the region of the closed ends of the longitudinal grooves, retention pockets are formed in the lower, closed ends of the longitudinal grooves that begin at the upper end face. In this way, the high impetus force of the oncoming fuel, which has also built up at the circumferential faces of the middle portion that make it easier for fuel to pass over them, is not propagated as far as the lowermost closed end (groove bottom) of the longitudinal grooves, so that the abrasive action of the particles collected there can be reduced. In the retention pockets that collect the chips, static pressure fields develop, so that the particles are now hardly reached at all by the impetus energy of the oncoming fuel.

Furthermore, the dimension of the gap at the axially closed groove bottom toward the wall of the inflow conduit is now less, which once again helps to prevent the formation of channels.

Another advantage in terms of the effectiveness of the fuel filter used is attained by the conical form on the upper collar, remote from the injection opening, whose cross section decreases steadily toward the middle portion. By means of this conical collar, when the filter body is press-fitted into the inflow conduit, a gradual deformation of the fitting parts is attained, thereby averting the creation of chips in the insertion of the filter in the first place. Moreover, by using this kind of conical press-fitted collar, greater diameter tolerances can be allowed between the filter body and the wall of the inflow conduit, the inflow conduit preferably being embodied as a bore, thus making it possible to dispense with previously conventional size groups or pairing groups that can be eliminated, which considerably lessens the effort and expense of production.

Further advantages and advantageous features of the subject of the invention can be learned from the specification, drawing and claims.

BRIEF DESCRIPTION OF THE DRAWING

One exemplary embodiment of the injection valve according to the invention for internal combustion engines is shown in the drawing and described in further detail below.

DETAILED DESCRIPTION OF THE DRAWINGS

Figure 1:
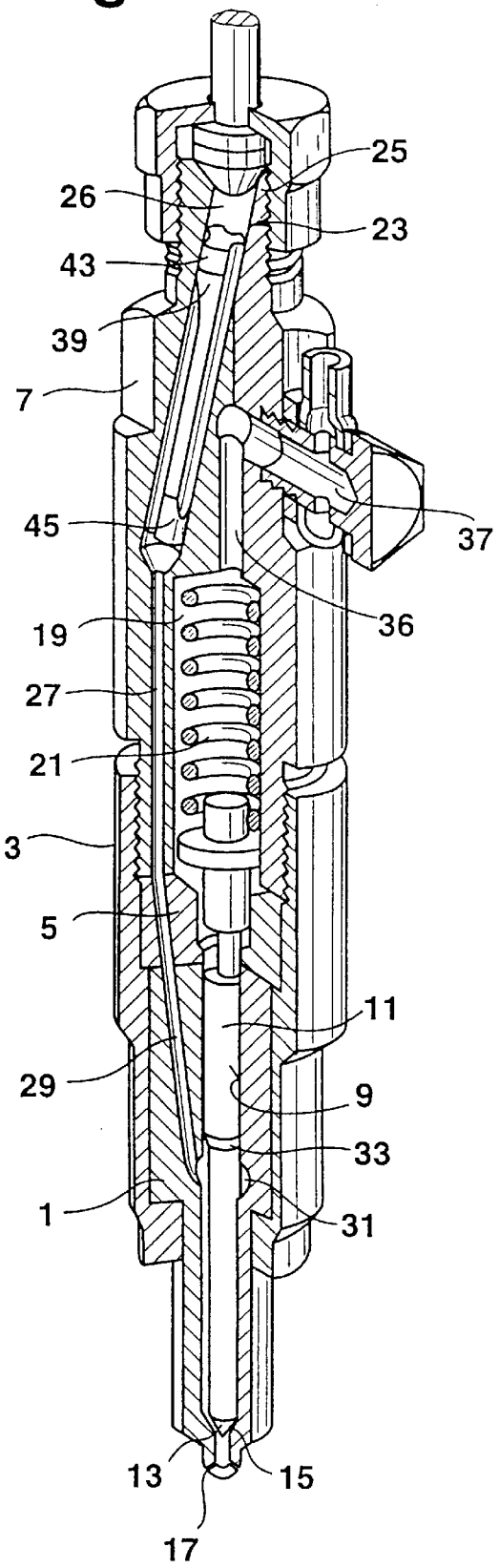
FIG. 1 shows the injection valve in a longitudinal section.

The fuel injection valve for internal combustion engines that is shown in FIG. 1 has a valve body 1, that protrudes into the combustion chamber of the engine to be supplied, which is fastened axially against a valve holding body 7 by means of a tension nut 3 with the interposition of a spacer or washer 5 machined to close tolerances. A pistonlike valve member 11 is axially guided in a guide bore 9 in the valve body 1 and with its lower end face, toward the combustion chamber, the valve member forms a valve sealing face 13, with which the valve member 11 cooperates to control an opening cross section, with an inward-cantilevered valve seat 15 on the guide bore 9. Downstream of the valve seat 15, at least one injection opening 17 is provided, which begins at the guide bore 9 and discharges into the engine combustion chamber.

A valve spring 21, which urges the valve member 11 in the closing direction toward the valve seat 15, is disposed in a spring chamber 19 in the valve holding body 7.

Also provided in the valve holding body 7 is a fuel inflow conduit 23, which penetrates the valve holding body 7 axially from a connection stub 25, provided on its upper end face remote from the injection opening 17, for a fuel injection line as far as the washer 5, and which comprises two bore segments 26, 27 of different diameter. The lower bore segment 27 discharges at a connection conduit 29, which penetrates the washer 5 and discharges into a pressure chamber 31 surrounding the valve member 11; this pressure chamber extends in the form of an annular gap along the shaft of the valve member 11 as far as the valve seat 15. In the region of the pressure chamber 31, the valve member 11 is provided with a pressure shoulder 33, which faces away from the valve seat 15 and which is engaged by the high fuel pressure in the opening direction of the valve member 11.

During the injection phase, the valve member 11 is displaced by the high pressure of the delivered fuel counter to the force of the valve spring 21 away from the valve seat 15, so that the opening cross section of the injection valve is opened, and the fuel passes via the injection openings 17 to attain injection into the engine combustion chamber. The leaking fuel thus passing into the spring chamber 19 is carried away, via a leaking fuel bore 36 that leads away from the spring chamber to a further stub 37 to which a leaking fuel line can be connected.

A fuel filter with a rodlike filter body 39 is inserted into the upper bore segment 26 of the fuel inflow conduit 23 and forces the inflowing fuel to pass through narrow gaps that are formed between the profiled-outer circumference of the filter body 39 and the wall, surrounding it, of the bore segment 26. In the process, the fuel is filtered, which traps entrained dirt particles and chips in the fuel that are beyond a certain size.

Figure 3:
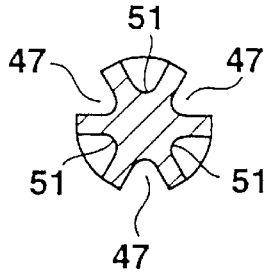
FIG. 3 is a section through the filter body taken along the line III.
Figure 2:
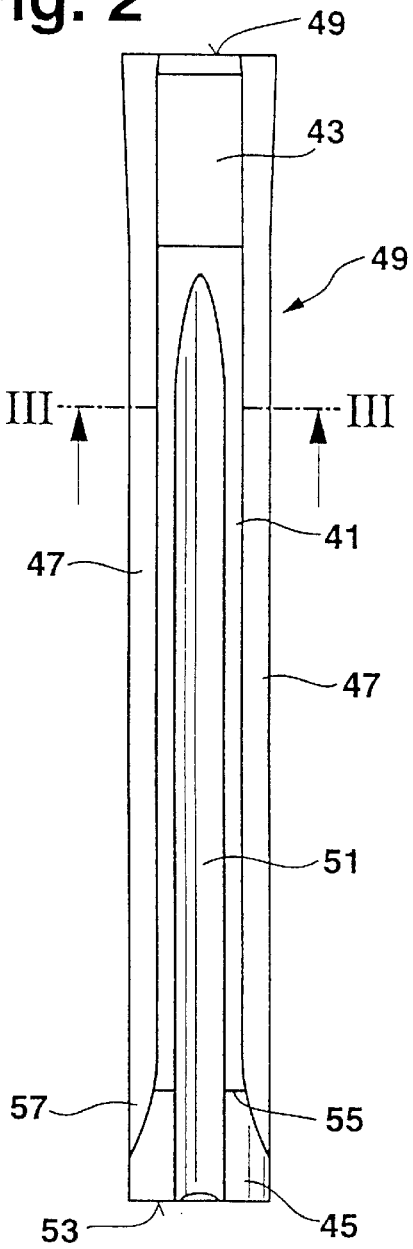
FIG. 2 shows an enlarged view of the filter body in the installed position of FIG. 1.

The filter body 39, which in FIGS. 2 and 3 is shown enlarged and in the installed position of FIG. 1, has one collar, on each of its face ends, of enlarged diameter compared to a middle portion 41; of these collars, an upper collar 43 is disposed on the inflow end of the filter body 39, toward the connection stub 25, and a lower collar 45 is disposed on the outflow end, toward the injection opening 17.

Two groups of longitudinal grooves axially closed on one end are also machined into the jacket face of the filter body 39; of them, a first group 47 begins at an upper end face 49 of the filter body 39, remote from the injection opening 17, and a second group 51 begins at a lower end face 53 of the filter body 39, toward the injection opening 17. The longitudinal grooves of the first and second groups 47, 51 are disposed in alternating distribution over the circumference of the filter body 39. The axially closed ends of the longitudinal grooves 47, 51 decrease their cross section continuously, which in the exemplary embodiment is done by a reduction in the depth and width of the grooves.

For trapping chips and dirt particles, particularly in the first group 47 of longitudinal grooves, the lower collar 45 extends to past the axially closed ends of these grooves, so that the annular shoulder 55 formed at the transition between the lower collar 45 and the middle portion 41 partly overlaps the longitudinal grooves of the first group 47.

In this way, in cooperation with the wall of the inflow conduit 23 that receives the filter body 39 in this region 26, retention pockets 57 are formed at the closed ends of the longitudinal grooves 47, and the particles that have been filtered out collect in these pockets.

The longitudinal grooves of the second group 51, extending in the opposite direction, end before reaching the upper collar 43. The lower collar 45 is embodied cylindrically, and its diameter is made only slightly smaller than the diameter of the bore 26 surrounding it, so that a narrow gap is formed between the lower collar 45 and the wall of the inflow conduit 23. The upper collar 43 has a form that tapers conically toward the middle portion 41. The largest diameter, provided on the upper end, of the conical upper collar 43 is made slightly larger than the diameter of the bore 26, so that the filter body 39 is fixed there by being press-fitted into the inflow conduit 23.

When fuel passes through the filter body 39, the fuel first enters the longitudinal grooves 47 of the first group 47, then in the middle portion 41 flows into the longitudinal grooves 51 of the second group 51, and at their open ends emerges from the filter body 39. The filtration of dirt particles takes place at the transition from the longitudinal grooves 47 of the first group to the longitudinal grooves 51 of the second group; the filter gap between the jacket face of the filter body 39 in the middle portion 41 is larger than the narrow gap at the collars 43, 45.

The trapped dirt particles and chips sink into the closed ends of the longitudinal grooves 47 and collect there in a retention pockets 57 that have been formed. By means of the axial overlap of the lower collar 45 with the retention pockets 57, the impetus force built up in the high-pressure fuel delivery is prevented from impacting the caught particles in such a way that they could drive channels into the wall of the filter body 39.

With the fuel injection valve of the invention, it is thus possible in a structurally simple way, even over a long period of operation, to avoid the passage of dirt particles and chips through the fuel filter and thus to prevent the damage and failure of the entire injection system that such dirt particles and chips could cause.

The foregoing relates to preferred exemplary embodiments of the invention, it being understood that other variants and embodiments thereof are possible within the spirit and scope of the invention, the latter being defined by the appended claims.

The invention claimed and desired to be secured by Letters Patent of the United States is:

1. A fuel injection valve for internal combustion engines, comprising a valve body (1), an inflow conduit (23) which leads away from a connection stub (25) and discharges at an injection opening (17) in said valve body, a rodlike filter body (39) is inserted into said inflow conduit preceding the injection opening (17), said rodlike filter body includes an upper collar (43), and a lower collar (45) on opposite face ends of enlarged diameter compared with a middle portion (41) of the filter body (39), a jacket face of said filter body includes a first group of longitudinal grooves beginning at an upper end face (49) of the filler body (39) remote from the injection opening and ending within said lower collar, said filter body further includes a second group of longitudinal grooves beginning at a lower end face (53) thereof toward the injection opening (17), and ending within the middle portion (41) of the filter body (39), the longitudinal grooves of the first and second groups (47, 51) are distributed in alternation over the circumference of the filter body (39), a portion of the lower collar (45), provided on the injection end of the filter body (39), extends beyond the axially closed end of the longitudinal grooves of the first group (47) that begin at the upper end face (49) of the filter body (39) remote from the injection opening (17).

2. A fuel injection valve in accordance with claim 1, in which a cross section of the longitudinal grooves (47, 51) decreases toward their axially closed end.

3. A fuel injection valve in accordance with claim 2, in which the cross-sectional reduction at the closed end of the longitudinal grooves (47, 51) is effected via a reduction in the depth and/or width of the longitudinal grooves.

4. A fuel injection valve in accordance with claim 1, in which the longitudinal grooves (51) beginning at the lower end face (53), toward the injection opening, of the filter body (39) end upstream of the upper collar (43), remote from the injection opening (17), of the filter body (39).

5. A fuel injection valve in accordance with claim 1, in which the lower collar (45), disposed on the injection end of the filter body (39), has a slight play relative to a wall of the inflow conduit (23) surrounding the filter body.

6. A fuel injection valve for internal combustion engines, comprising a valve body (1) an inflow conduit (23) which leads away from a connection stub (25) and discharges at an injection opening (17) in said valve body (1), a rodlike filter body (39) is inserted into said inflow conduit preceding the injection opening (17), said rodlike filter body includes an upper collar (43) and a lower collar (45) on opposite face ends of enlarged diameter compared with a middle portion (41) of the filter body (39), a jacket face of said filter body includes a first group of longitudinal grooves axially closed on one end by said lower collar and a second group of longitudinal grooves axially closed on one end by said upper collar, said first group (47) begins at an upper end face (49) of the filter body (39) remote from the injection opening and the second group (51) begins at a lower end face (53) thereof toward the injection opening (17) and extend in a direction of said upper collar, the longitudinal grooves of the first and second groups (47, 51) being distributed in alternation over the circumference of the filter body (39), a cross section of the upper collar (43), remote from the injection opening (17), on the filter body (39) decreases uniformly in the direction of the middle portion (41).

7. A fuel injection valve in accordance with claim 6, in which the largest diameter of a cone formed on the upper collar (43) of the filter body (39) is embodied as larger than the conduit cross section of the inflow conduit (23) in a region (26) where the filter body (39) is received.

* * * * *